US008820419B2

(12) United States Patent
Adam

(10) Patent No.: US 8,820,419 B2
(45) Date of Patent: Sep. 2, 2014

(54) WASHOVER TIEBACK METHOD

(75) Inventor: Mark K. Adam, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 259 days.

(21) Appl. No.: 13/478,650

(22) Filed: May 23, 2012

(65) Prior Publication Data

US 2013/0312981 A1 Nov. 28, 2013

(51) Int. Cl.
*E21B 43/10* (2006.01)

(52) U.S. Cl.
USPC ..... 166/384; 166/382; 166/387; 166/208

(58) Field of Classification Search
CPC ... E21B 43/103; E21B 43/105; E21B 43/106; E21B 43/108
USPC ..... 166/378, 380–387, 243, 206–217
See application file for complete search history.

(56) References Cited

U.S. PATENT DOCUMENTS

| | | | | |
|---|---|---|---|---|
| 4,293,146 | A | 10/1981 | Beynet et al. | |
| 4,519,633 | A | 5/1985 | Nichols | |
| 4,653,589 | A | 3/1987 | Alandy | |
| 5,259,459 | A | 11/1993 | Valka | |
| 5,279,369 | A | 1/1994 | Brammer | |
| 5,299,642 | A | 4/1994 | Nelson et al. | |
| 5,775,427 | A | 7/1998 | Skeels et al. | |
| 6,666,272 | B2 | 12/2003 | Singeetham et al. | |
| 6,843,322 | B2 * | 1/2005 | Burtner et al. | 166/382 |
| 7,195,073 | B2 * | 3/2007 | Fraser, III | 166/380 |
| 7,422,068 | B2 * | 9/2008 | Lynde | 166/380 |
| 7,896,081 | B2 | 3/2011 | Pallini et al. | |
| 8,127,853 | B2 | 3/2012 | Pallini et al. | |
| 2003/0145996 | A1 | 8/2003 | Singeetham et al. | |
| 2004/0069499 | A1 * | 4/2004 | Cook et al. | 166/380 |
| 2006/0000617 | A1 * | 1/2006 | Harrall et al. | 166/380 |
| 2006/0005973 | A1 * | 1/2006 | Harrall et al. | 166/384 |
| 2006/0065403 | A1 * | 3/2006 | Watson et al. | 166/380 |
| 2008/0302541 | A1 * | 12/2008 | Farquhar et al. | 166/380 |
| 2009/0266560 | A1 * | 10/2009 | Ring et al. | 166/384 |
| 2009/0277645 | A1 | 11/2009 | Pallini et al. | |
| 2010/0089591 | A1 | 4/2010 | Thomson et al. | |
| 2010/0314130 | A1 | 12/2010 | Durst et al. | |
| 2011/0155382 | A1 | 6/2011 | Pallini | |

OTHER PUBLICATIONS

Schlumberger Oilfield Glossary entry for "tile-back string", accessed May 8, 2014 via www.glossary.oilfield.slb.com.*

* cited by examiner

*Primary Examiner* — Blake Michener
(74) *Attorney, Agent, or Firm* — Steve Rosenblatt

(57) ABSTRACT

A tieback receptacle is configured with an exterior cone and externals seals with a clearance space to accept a tieback shoe that will wash over the receptacle and expand when landed and advanced over the cone. The lower end of the shoe is tapered so that the thickness opposing the upper seal adds to burst and collapse resistance while the tapered lower end allows a thicker receptacle to be used in the area of the lower seal. The expansion can be accomplished with setting down weight which can also enhance the set of the liner hanger below. Minimal expansion in the order of 3% or less is needed. Exterior slots create cement flow passages and a no-go for the stem to prevent damage to the box further below. A metal to metal seal is created at the cone that is straddled by the exterior seals on the extension.

17 Claims, 2 Drawing Sheets

WASHOVER TIEBACK METHOD

FIELD OF THE INVENTION

The field of this invention is tieback connections above a liner top packer and hanger and more particularly where the tieback extension travels over the liner hanger stem for sealing to the outside of the stem.

BACKGROUND OF THE INVENTION

Conventional liner hangers are tied back via a larger extension with a seal bore at the top of the preinstalled liner hanger and a smaller tieback stem with outside diameter seals at the bottom of the upper tieback string. In recent years there has been a challenge with tighter tolerance liners. As the outside diameter of the liner to the inside diameter of the casing gap closes, the room for an extension closes. The result is low extension pressure capability due to thin sleeves and reduced cementing capabilities due to high pressures required to circulate cement through the skinny extension outside diameter to casing inside diameter annulus.

This concept is illustrated in FIG. 1. FIG. 1 illustrates a casing 10 inside of which is a liner 12 that is attached and sealed with a liner hanger 14 and liner top packer 16 respectively. The stem 18 is at the lower end of a tieback sting 20 and typically has a plurality of seals 22 that engage the seal bore 24 inside the extension 28. A clearance 26 is needed to allow cement to pass before the packer 16 is set. With the advent of narrower clearances between the liner 12 and the casing 10 the extensions have been made thinner to preserve clearance 26 so as to not increase the equivalent circulating density with undue cement pressure needed to get the cement through a narrow gap 26 if the initial clearance is already reduced. To offset for the reduced clearance the thickness of the extension 12 is reduced.

This invention turns the conventional tieback connection upside down. The tieback receptacle on the top of the liner hanger is a smaller tube for sealing on the outside diameter with dimensions more or less equivalent to the liner pipe. The tieback shoe that is run on the bottom of the tieback string has dimensions that are more or less similar to the extensions of before. A couple of additional improvements are made. The first improvement is the ability to expand the shoe over the tieback receptacle creating a metal to metal seal and sandwiching steel from the pass through inside diameter all the way to the previous casing (in which the liner hanger is set) outside diameter for improved pressure capacity. The second improvement is making the top of the tieback receptacle have 2 different diameters or 2 steps which allow for improved pressure capacity. The smaller diameter at the top allows for a thicker outer section to carry internal pressure before disengaging the seal. The larger diameter below allows for more collapse capacity on the internal piece.

The following art is generally related to tiebacks and expansion: U.S. Pat. No. 7,195,073 Expandable tieback; U.S. Pat. No. 5,259,459 Subsea wellhead tieback connector; U.S. Pat. No. 5,299,642 Subsea wellhead tieback connector; U.S. Pat. No. 4,293,146 VMP Casing tieback; U.S. Pat. No. 4,519,633 Subsea well casing tieback connector; US2009/0277645 Internal Tieback for Subsea Well; U.S. Pat. No. 7,896,081 Internal tieback for subsea well; US2011/0155382 Internal Tieback for Subsea Well; U.S. Pat. No. 8,127,853 Internal tieback for subsea well; US2003/0145996 Externally actuated subsea wellhead tieback connector; U.S. Pat. No. 6,666,272 Externally actuated subsea wellhead tieback connector; U.S. Pat. No. 5,775,427 Internally latched subsea wellhead tieback connector; U.S. Pat. No. 5,279,369 Tieback receptacle with upward and downward facing funnel sections; U.S. Pat. No. 4,653,589 Mudline casing hanger tieback adaptor with adjustable load ring.

US 2010/0314130 is generally related to tubular expansion with a swage using internal supports to enhance the amount of expansion. US 2010/0314130 A1 by Douglas Durst of Enventure shows mid-string packing elements including a spacer that. US 2010/0089591 A1 by Gordon Thomson shows an under-gage shape hanger in FIG. 19.

Those skilled in the art will better appreciate additional aspects of the invention from a review of the detailed description and the associated drawings while recognizing that the full scope of the invention is to be determined by the appended claims.

SUMMARY OF THE INVENTION

A tieback extension is configured with an exterior cone and externals seals with a clearance space to accept a tieback stem that will wash over the extension and expand when landed and advanced over the cone. The lower end of the stem is tapered so that the thickness opposing the upper seal adds to burst and collapse resistance while the tapered lower end allows a thicker extension to be used in the area of the lower seal. The expansion can be accomplished with setting down weight which can also enhance the set of the liner hanger below. Minimal expansion in the order of 3% or less is needed. Exterior slots create cement flow passages and a no-go for the stem to prevent damage to the box further below. The extension is hardened and the sleeve can be coated to facilitate expansion. A metal to metal seal is created at the cone that is straddled by the exterior seals on the extension.

DETAILED DESCRIPTION OF THE PREFERRED EMBODIMENT

Figure 1:
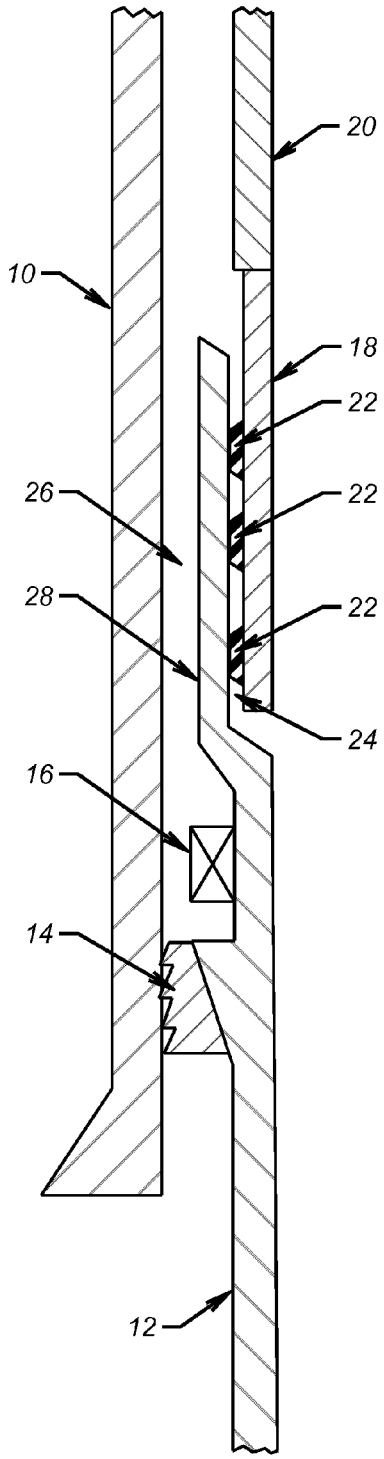
(PRIOR ART) FIG. 1
FIG. 1 is a section view of a prior art tieback stem inserted into a liner/packer extension seal bore.
Figure 2:
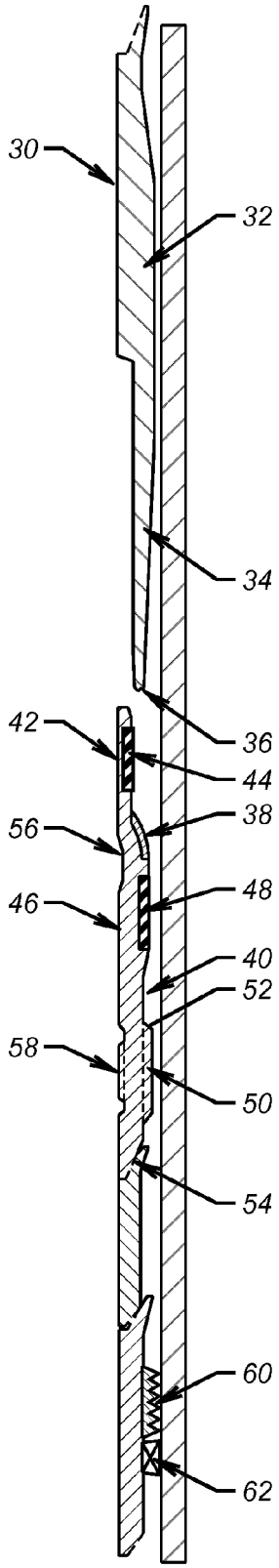
FIG. 2 is the view of the tieback shoe of the present invention before expansion by travelling over the cone integral to the tieback receptacle.
Figure 3:
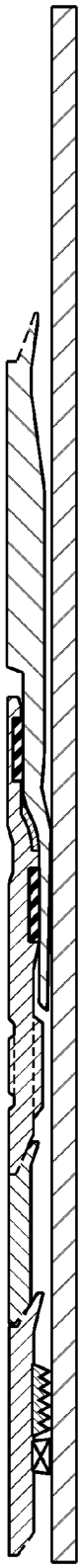
FIG. 3 is the tieback shoe shown after advancing over the tieback receptacle and being expanded for a metal to metal seal that is straddled by external seals on the tieback receptacle.

FIG. 2 shows the tieback shoe of the present invention before its expansion. The shoe 30 has a thick upper end 32 for structural strength and a tapering lower end 34 leading to a flat bottom 36. The tapered lower end 34 can also be coated inside and out to reduce the force that is brought to bear on it when advancing it over the cone segment 38 of the tieback receptacle 40. The tieback receptacle 40 has a thin upper segment 42 that has an exterior seal 44. The body 46 of the receptacle 40 is thicker so that seal 48 is at a larger diameter. The seals 44 and 48 straddle the metal to metal seal formed between the tapered segment 34 of the shoe and cone segment 38 of the receptacle. The smaller diameter at seal 44 allows the use of a thicker tapered segment 34 at seal 44 which increases the internal pressure rating on the seal before deformation allows fluid to bypass the seal. The larger diameter at seal 48 improves the collapse resistance of the extension 40 that is therefore thicker in that location. Seal 48 adds redundancy to the metal to metal seal at cone surface 38. External fins 50 are provided to both centralize the receptacle in the casing and define conduits for cement flow during earlier operation before the tieback string with the stem 30 at its lower end is introduced into the wellbore. The exterior dimension near the passages 50 is no larger than hanger 60 and packer 62 for run in. These fins 50 also define a no-go shoulder 52. The intention is not to land the lower end 36 on the no-go 52 but rather to protect the box threads 54 if the expansion is not earlier stopped by landing at the wellhead that is not shown. Receptacle 40 is preferably a hardened metal so that the cone segment 38 can tolerate the loading during expansion. The expansion can be performed with setting down weight on the tieback string or adding load with fluid pressure or heavier weight mud or with mechanical force from a tool on a drill string inserted in another trip into the tieback string that has stem 30 at its lower end. A recess 56 is provided in the region lower than the cone 38 to ensure that there is no drift reduction due to the expansion.

An interior profile 58 allows a known running tool to deliver the liner with the extension 40 as well as hanger 60 and packer 62.

In an example of the method the wellbore is drilled to 14.5 inches in diameter followed by scraping the 16 inch casing above. The liner is run to the point where the hanger 60 and the packer 62 are properly positioned near the lower end of the 16 inch casing. The hanger 60 is set and the running tool released followed by cementing. The packer 62 is then set and the running string is pulled out of the hole. The shoe 30 is secured to the lower end of the tieback string and the shoe 30 is brought down on the conical surface 38 of the receptacle 40 and is advanced to a point short of no-go 52 at a point preferably located near the wellhead, not shown. Optionally the tieback string can also be cemented.

This invention turns the conventional tieback connection upside down. The tieback receptacle on the top of the liner hanger is a smaller tube for sealing on the outside diameter with dimensions more or less equivalent to the liner pipe. The tieback shoe that is run on the bottom of the tieback string has dimensions that are more or less similar to the extensions of before. A couple of additional improvements are made. The first improvement is the ability to expand the shoe over the tieback receptacle creating a metal to metal seal and sandwiching steel from the pass through inside diameter all the way to the previous casing (in which the liner hanger is set) outside diameter for improved pressure capacity. The second improvement is making the top of the tieback receptacle have 2 different diameters or 2 steps which allow for improved pressure capacity. The smaller diameter at the top allows for a thicker outer section to carry internal pressure before disengaging the seal. The larger diameter below allows for more collapse capacity on the internal piece. Another item is an expandable liner hanger packer that has the same outside diameter as the liner string before expansion. After expansion the liner hanger packer has the same inside diameter as the liner string. This liner packer design would be preferred for pressure capability, run in clearance, cementing and equivalent circulating density of the cement.

The above description is illustrative of the preferred embodiment and many modifications may be made by those skilled in the art without departing from the invention whose scope is to be determined from the literal and equivalent scope of the claims below.

I claim:

1. A method of joining a shoe on a tieback string to a receptacle of a liner string extending above a hanger and/or packer, comprising:

providing an outer periphery of said receptacle with an external downwardly widening portion;

providing said shoe with a lower axial stem;

bringing said stem into close proximity around said outer periphery of said receptacle;

expanding said stem against said downwardly widening portion via downward axial movement of said shoe.

2. The method of claim 1, comprising:

getting a metal to metal seal between said stem and said receptacle.

3. The method of claim 1, comprising:

providing at least one external seal on said receptacle;

using said external seal to seal against said shoe.

4. The method of claim 3, wherein:

said at least one external seal comprises a plurality of seals having different diameters.

5. The method of claim 4, comprising:

placing a smaller said seal on an opposite side of said downwardly shaped portion than a larger said seal.

6. The method of claim 5, comprising: sealing against said receptacle after expansion of said stem with said larger and smaller seal.

7. The method of claim 1, comprising:

accomplishing said expanding at least in part with setting down weight on the tieback shoe.

8. The method of claim 1, comprising:

accomplishing said expanding at least in part with pressure or with force applied through a tool.

9. The method of claim 4, comprising:

providing a thinner wall at said seal nearest an upper end of said receptacle than the wall thickness adjacent another said seal mounted on an opposite side of said downwardly shaped portion.

10. The method of claim 1, comprising:

configuring said stem to taper to a thinner dimension toward a lower end thereof.

11. The method of claim 1, comprising:

applying a coating to said stem to facilitate its expansion.

12. The method of claim 1, comprising:

providing an internal recess on said receptacle to maintain drift dimension through the interior of said extension.

13. The method of claim 1, comprising:

providing an internal profile on said receptacle;

using said profile to retain said receptacle for delivery to a desired subterranean location prior to setting of said hanger and/or packer.

14. The method of claim 1, comprising:

providing a plurality of axially extending fins that define a no-go shoulder for said shoe during expansion and for centralizing said receptacle in casing.

15. The method of claim 14, wherein:

the fins are no larger than said hanger and/or packer to allow for installation downhole.

16. The method of claim 1, comprising:

placing said receptacle in a surrounding tubular ahead of running said shoe downhole;

advancing said shoe between said receptacle and said surrounding tubular.

17. The method of claim 16, comprising:

providing a taper on said stem;

advancing said stem to make contact with both said surrounding tubular and said receptacle after expansion.

* * * * *